US005173118A

United States Patent [19]

Josefsson

[11] Patent Number: 5,173,118

[45] Date of Patent: Dec. 22, 1992

[54] PAINT SPRAY BOOTH WITH ADJUSTABLE PARTITIONS

[75] Inventor: Leif E. B. Josefsson, Sterling Heights, Mich.

[73] Assignee: ABB Flakt, Inc., Madison Heights, Mich.

[21] Appl. No.: 702,825

[22] Filed: May 20, 1991

[51] Int. Cl.[5] ..... B05B 15/12

[52] U.S. Cl. ..... 118/309; 118/326; 118/DIG. 7; 454/50

[58] Field of Search ..... 454/50, 51, 53; 118/309, 326, 634, DIG. 7; 52/238.1, 239

[56] References Cited

U.S. PATENT DOCUMENTS

| | | |
|---|---|---|
| 1,520,796 | 12/1924 | Bartling . |
| 1,697,079 | 1/1929 | Onsrud . |
| 1,876,528 | 9/1932 | Walters . |
| 2,761,373 | 9/1956 | Owen . |
| 3,824,912 | 7/1974 | Jensen et al. . |
| 4,241,646 | 12/1980 | Tsuruta et al. . |
| 4,338,364 | 7/1982 | Kennon et al. . |
| 4,608,066 | 8/1986 | Cadwell, Jr. . |
| 4,771,728 | 9/1988 | Bergman, Jr. . |
| 4,932,316 | 6/1990 | Josefsson . |

FOREIGN PATENT DOCUMENTS

| | | |
|---|---|---|
| 0021209 | 1/1981 | European Pat. Off. . |
| 2936367 | 3/1981 | Fed. Rep. of Germany . |
| 3640699 | 6/1988 | Fed. Rep. of Germany . |
| 1212617 | 2/1986 | U.S.S.R. . |

OTHER PUBLICATIONS

Ford Motor Company Request for Quotation, Purchase Order and Sketch dated Oct. 11, 1988.

*Primary Examiner*—W. Gary Jones
*Assistant Examiner*—Charles K. Friedman
*Attorney, Agent, or Firm*—Harness, Dickey & Pierce

[57] ABSTRACT

Partitions in a paint spray booth are adjustably coupled to a grated ceiling of the booth and extend to preselected heights above a grated floor of the booth. The adjustable partitions define a paint spray application zone therebetween wherein air flow rate between the ceiling and the floor of the booth is chosen for optimum paint transfer and overspray removal efficiency, while air flow between the partitions and the booth outer walls may be much lower to conserve investment and running costs. Air flow reducers, such as adjustable perforated plates, are positioned on the grated ceiling above the low rate air flow spaces between the partitions and the outer walls.

15 Claims, 3 Drawing Sheets

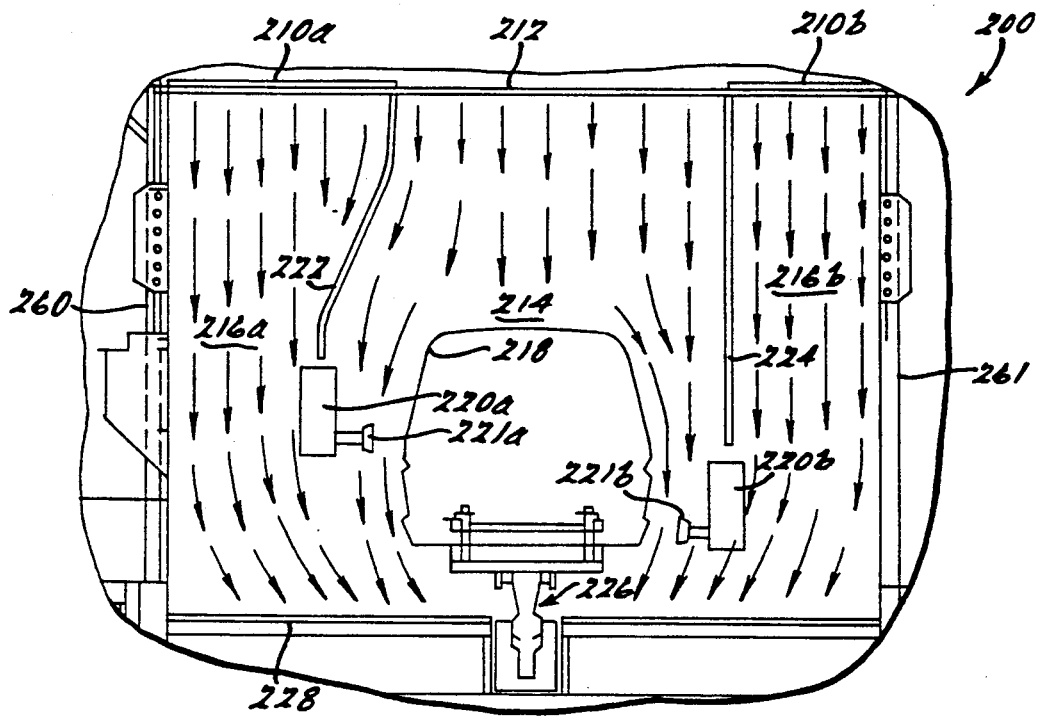
FIG. 2.
FIG. 3.
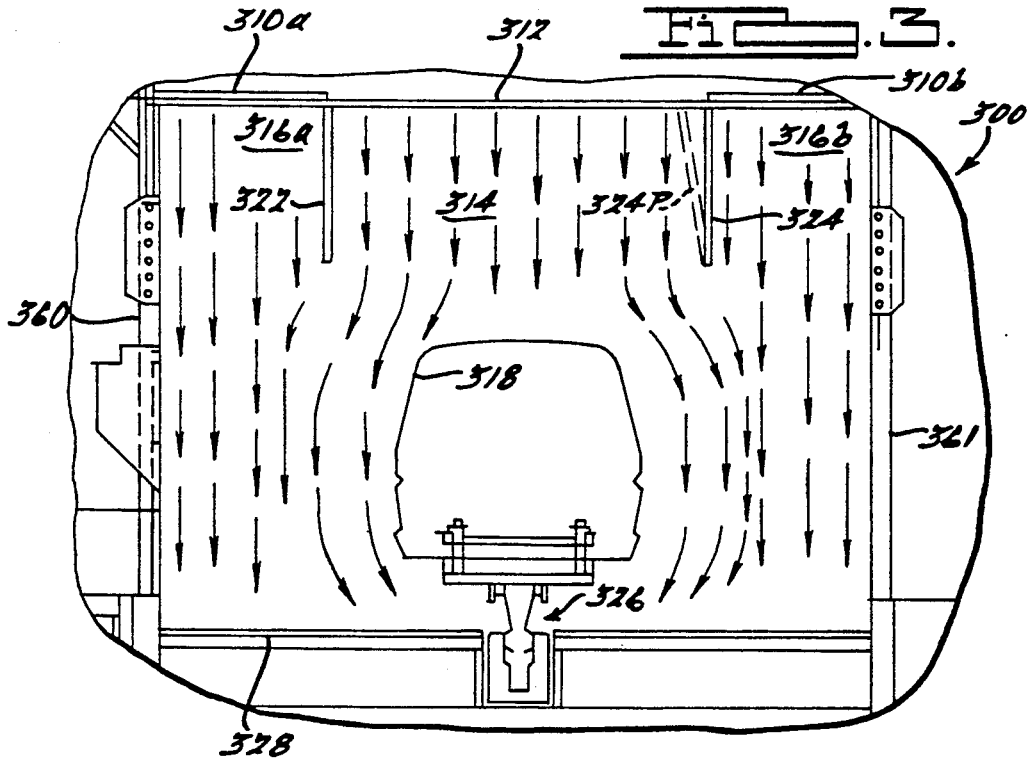

PAINT SPRAY BOOTH WITH ADJUSTABLE PARTITIONS

BACKGROUND OF THE INVENTION

The present invention generally relates to an improvement for paint spray booths and, more particularly, is concerned with a spray booth designed to minimize air supply volume flow requirements while at the same time minimizing overspray buildup in the vicinity of critical apparatus located within the booth.

Paint spray booths are typically found in production lines for products such as automobiles. Parts of the automobile body which must be painted are conveyed into an enclosed booth and the desired paint is applied by spraying the paint either at preselected locations via specially designed apparatus, manually by human operators, or through the use of robotics.

Much of the paint emitted from the spray apparatus never reaches the part being painted, but appears as overspray in the booth's atmosphere. This overspray must be removed from the booth for a variety of reasons. It cannot be allowed to fall back on the painted body or the interior of the booth. Removal of the overspray is best accomplished if the booth is provided with a laminar air flow with sufficient air velocity to provide an exhaust stream for carrying the overspray along with it. In a conventional booth, the air enters a booth through a perforated ceiling, usually comprised of a wire mesh and flows down through a perforated floor, usually steel grating, thereby creating a constant down draft. In many conventional booth systems, downward draft exhaust air carries the overspray through the floor where it mixes with water to be disposed of as sludge.

Since paint spray booths can be hundreds of feet long with many work stations along the way, it is desirable to be able to apply different coats of paint to the parts as they pass through the booth. Cross contamination should be avoided by preventing the paint at each work station from drifting through the overspray to the next work station.

Temperature and humidity conditions in the booth must also be monitored very closely. Certain paints, for instance, require very accurate controls at these two variables.

Another concern of paint spray booths is emissions into the atmosphere. In order to reduce the concentration of paint particles in the air exhausted to the environment, the air leaving the floor of the paint spray booth must be cleaned.

Removing overspray, controlling air temperature and humidity and cleaning paint particles from the exhaust air requires large amounts of operating energy. The energy requirements can be very expensive, and therefore reducing the energy required for each of the aforementioned concerns and lowering capital investment for related equipment can be accomplished by minimizing the total required air volume flow rate inside a paint spray booth at each work station.

One prior approach to minimizing the required air volume flow rate is set forth in U.S. Pat. No. 4,932,316 wherein a paint spray booth is provided with movable inner walls which can be placed around a workstation in such a way as to allow room for the work to be accomplished, while keeping the total area of the workstation wherein the exhaust air must flow at a minimum. The inner walls are constructed of a light weight material which would allow for easy manual placement inside the booth. However, it has been found that a booth with movable walls which extend from the ceiling of the booth all the way to the floor may allow for unacceptable overspray buildup in the area of the spray applicators, especially in electrostatic paint sprayer applications. Where the movable walls extend for the full heighth between ceiling and floor of the booth, the spray applicator would be totally within the application area, thus subjecting itself to undesirable buildup, especially in an electrostatically charged particle environment.

SUMMARY OF THE INVENTION

Accordingly, to minimize the required air supply flow rates to a spray booth workstation zone, yet avoid undesirable overspray buildup on hardware in the booth such as the spray applicator device, the invention is directed to an improvement for a paint spray booth enclosure having controlled air flow through a perforated ceiling and a perforated floor, the floor and ceiling being interconnected by vertically extending booth outer side walls. At least one partition wall is positioned interiorly of the booth outer side walls, the partition wall coupled to and extending downwardly from the perforated ceiling to a preselected height above the perforated floor. An air flow controller is operative to alter the controlled air flow through a space between the partition and the booth side walls.

It is a feature of this invention that the critical air flow control rate need be maintained only in a zone between the partition walls, while the air flow rate between the partition walls and the outer walls of the booth may be kept at a minimum. This, in turn, minimizes investment costs for the air supply unit, the exhaust system, and the volatile organic carbons abatement system. Additionally minimized will be the running costs comprised principally of energy costs for maintaining the air flow rate and temperature in the booth.

It is a further feature of the invention that the paint transfer efficiency between the paint spray applicator and the body being painted is increased, since the correct air flow velocity around the body being painted is more critically maintained.

BRIEF DESCRIPTION OF THE DRAWINGS

The objects and features of the invention will become apparent from a reading of a detailed description taken in conjunction with the drawings, in which:

FIG. 2 is a sectional view of a first alternative embodiment of the invention;

FIG. 3 is a sectional view of a second alternative embodiment of the invention.

DETAILED DESCRIPTION

Figure 1:
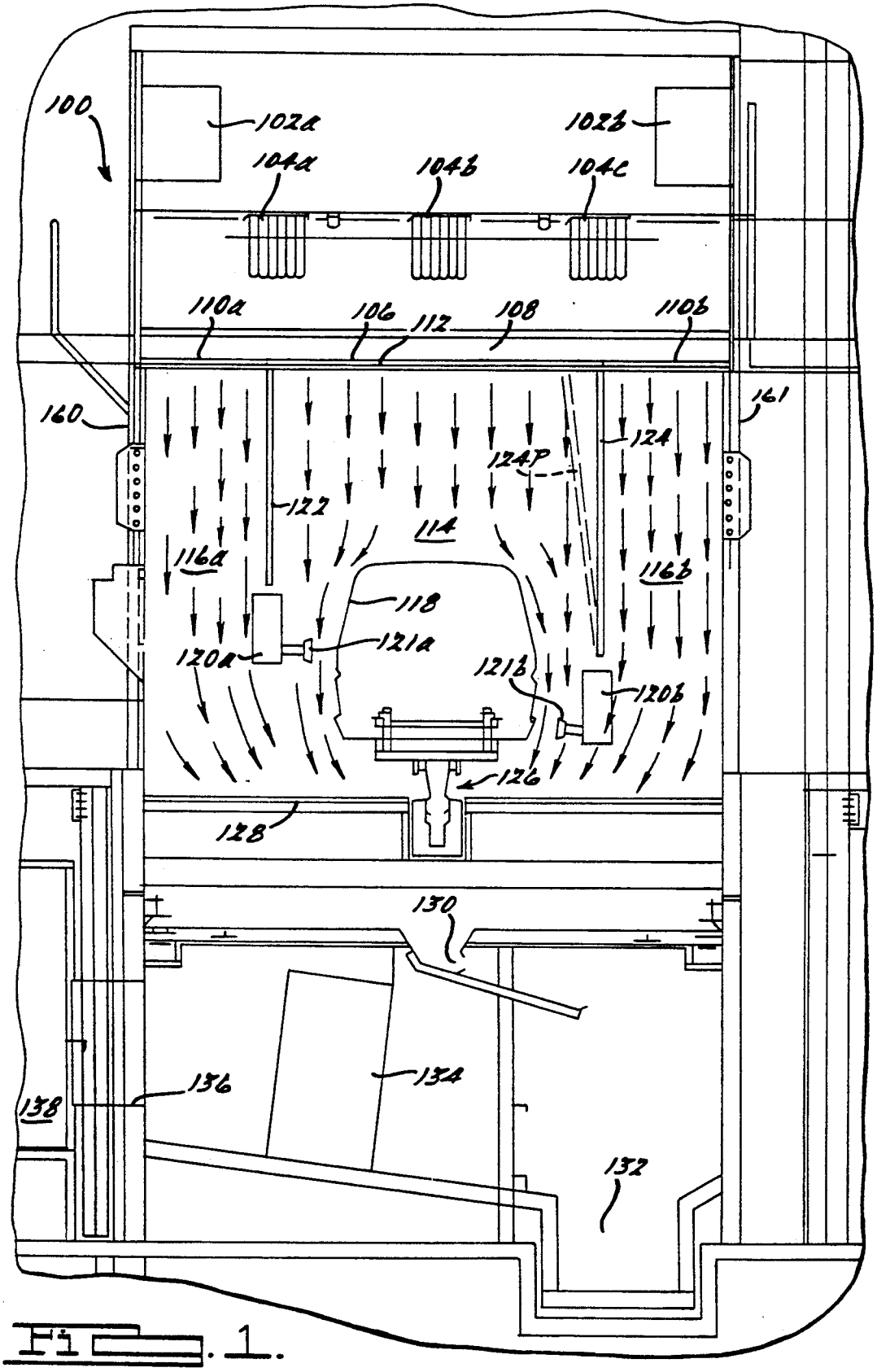
FIG. 1 is a sectional view of a paint spray booth with inner partitions arranged in accordance with the principles of the invention.

The cross section view of FIG. 1 sets forth the pertinent details of a paint spray booth 100 having inner adjustable partition walls arranged in accordance with the principles of the invention. The invention has particular advantage in paint spray booths employing electrostatic paint spray application devices.

Spray booth 100 has conventional inlet air ducts 102*a* and 102*b* which may include a fan and damper assembly for controlling the main flow of inlet air into the booth. The inlet air then passes through a plurality of inlet air bag-type filters 104*a*, 104*b*, and 104*c*, and then is passed through a bed of filter material 108 supported by inlet filter framework 106 above a steel mesh booth ceiling 112.

The filter material 108, which may, for example, comprise a blanket synthetic media diffusion filter, additionally overlies air flow control units 110*a* and 110*b* which, for example, may comprise either single perforated plates for reducing the air flow therethrough or alternatively, could comprise plates with adjustable size gratings for adjusting the diminished air flow therethrough. For example, each apparatus 110*a*, 110*b* could comprise two perforated plates slidable laterally with respect to each other such that the size of perforations could be adjusted.

Removably coupled to the steel mesh ceiling 112 of the booth are shown a pair of partition walls 122 and 124. Wall 122 extends downwardly toward the floor of the booth and terminates just above a first electrostatic paint spray assembly 120*a* which feeds a spray head 121*a*. Partition wall 124 extends downwardly to a position immediately above a second electrostatic paint spray assembly 120*b* with its accompanying spray head 121*b*. It is to be understood that there could be yet other paint spray applicators located at various locations along the booth and at differing heights. It is also to be understood that the two partition walls shown in FIG. 1 are not necessarily the only partitions in the booth. That is, there can be a series of panel-type partitions of various lengths and located at various distances from the booth's outer walls 160 and 161 as one proceeds from one booth workstation to the next.

A typical body 118 to be painted is shown mounted to a conveyor assembly 126 which moves a series of such bodies longitudinally through the booth for paint spray application above the booth's grated floor 128.

The cleansing air flow through the booth from ceiling to floor is shown by the arrows in FIG. 1, and it will be apparent that overspray and exhaust air carrying same exits the booth through the grated floor 128 and is then directed towards an air cleaning system comprised of a venturi passage 130 carrying air-cleaning water and which extends into a paint-laden water collection well 132, along with a water/air separator labyrinth 134. From the separator 134 the exhaust air is directed through an exhaust air plenum 136 into a spray booth exhaust duct 138.

With the arrangement depicted in FIG. 1 it will be seen that three separate air flow zones are defined by the partition walls 122 and 124. Central zone 114 defines the actual paint spray application section of the booth in the location of a work station which includes paint spray assemblies 120*a* and 120*b*. Area 116*a* is an outer zone between partition 122 and outer wall 160 and includes other booth apparatus such as duct work and plumbing which does not need to be in the spray application zone centrally located of the booth. Similarly, outer zone 116*b* is defined to be between second partition wall 124 and booth outer wall 161. The main exhaust air flow from ceiling to floor in the booth is controlled by inlet air duct and fan systems 102*a* and 102*b* and is directed downwardly through the ceiling and through zone 114, over the body 118 being painted and along spray applicator heads 121*a* and 121*b*, then through grated floor 128 into the conventional scrubber system provided at the bottom of the booth. The inlet air supply passes through air flow control apparatus 110*a* into zone 116*a* and via control apparatus 110*b* into outer zone 116*b*.

With the arrangement of FIG. 1, tighter control of the required air flow velocity in the workstation central zone 114 may be effected. Outside the central zone in the side zones 116*a* and 116*b*, air flow of just enough velocity to maintain a downdraft toward the scrubber apparatus beneath the ceiling is all that is required. It is at these sections 116*a* and 116*b* which are outside of the actual spray application area 114 that the most energy savings can be effected.

It has been found in experimental applications that the air flow rate in the central zone may be maintained in the range of from about 30 to about 75 feet per minute with excellent results while the flow rates in the outer zones 116*a* and 116*b* may be maintained in the range of from about 5 to about 25 feet per minute.

Finally, with reference to FIG. 1, as shown in phantom lines 124P, it is not necessary that any of the partition walls extend from the ceiling at a 90° angle. Any extension angle may be utilized depending upon the shape, size and location of the non-spray applying apparatus housed within the booth which is to isolated from the central spray application zone 114.

In this regard, it will be further noted from the first alternative arrangement set forth in the cross-sectional view of FIG. 2 that the partition walls extending downwardly from the booth's ceiling need not planar, but may be bent or curved in any desired shape, again, so as to accommodate the shape and location of the duct work, plumbing, etc. within the booth which one wishes to be isolated from a central application zone such as zone 214 of FIG. 2. With the exception of the shape of partition wall 222 of FIG. 2, the remaining pertinent details in the booth of FIG. 2 are substantially identical to those set forth in the view of FIG. 1. Corresponding elements of FIG. 1 and FIG. 2 are designated by the last two digits being identical. Each designator in FIG. 2 begins with the number 2 rather than with the number 1, as in FIG. 1. For example, the air flow control apparatus in FIG. 2 is designated as 210*a*, 210*b*, the steel mesh ceiling is designated as 212 and the various air flow zones as 214, 216*a* and 216*b*, etc.

Again, as was the case with FIG. 1, the partitions need not extend entirely along the length of the booth but may come in longitudinal sections allowing for varying widths of the application space 214 as one proceeds along a longitudinal axis of the spray booth.

As with the embodiment of FIG. 1, good results have been experimentally attained utilizing an embodiment such as set forth in FIG. 2 by maintaining flow rates of between about 30 to about 75 feet per minute in the central zone 214, while maintaining flow rates of between about 5 and about 25 feet per minute in outer zones 216*a* and 216*b*.

With reference to FIG. 3, a second alternative embodiment is set forth in a cross-sectional view of spray booth 300. In the arrangement of FIG. 3, it is contemplated that the paint will be applied either by human operators or by robotics which requires substantially more heighth to be available immediately beneath the partition walls 322 and 324. In a manual application, space for the operator precludes use of longer partition walls as in the booths 100 and 200 of FIG. 1 and FIG. 2, respectively. Even in manual or robotics situations, with relatively short partition walls 322 and 324, energy savings can still be effected by decreasing the air flow rates along the outer peripheries of the booth adjacent outer walls 360 and 361.

As with the alternative arrangement of FIG. 2, the pertinent elements of the booth shown in FIG. 3 are substantially identical to those set forth in FIG. 1 and the numerical designations are likewise identical except for the prefix number 3.

In a manual (or robotics) zone, it has been found that the partition walls 322 and 324 must be at least two to three feet in vertical length to obtain beneficial results. Typical overall spray booth heights are in the range of 12 to 13 feet and therefore, 2 to 3 feet partition walls still leaves 9 to 11 feet of space for human operators or robotics apparatus.

Also, as shown in FIG. 3, booth 300 may be equipped with a short partition wall which extends at a nonperpendicular angle from ceiling 312, such as shown in phantom at 324P. Additionally, partitions walls 322 and 324 do not necessarily extend for the total longitudinal length of the booth, but may comprise shorter panels which are arranged at the positions shown only in a specified workstation area. A series of such panels may make up the entire longitudinal length of the booth with each panel being located at variable positions with respect to the outer walls 360 and 361.

Figure 4:
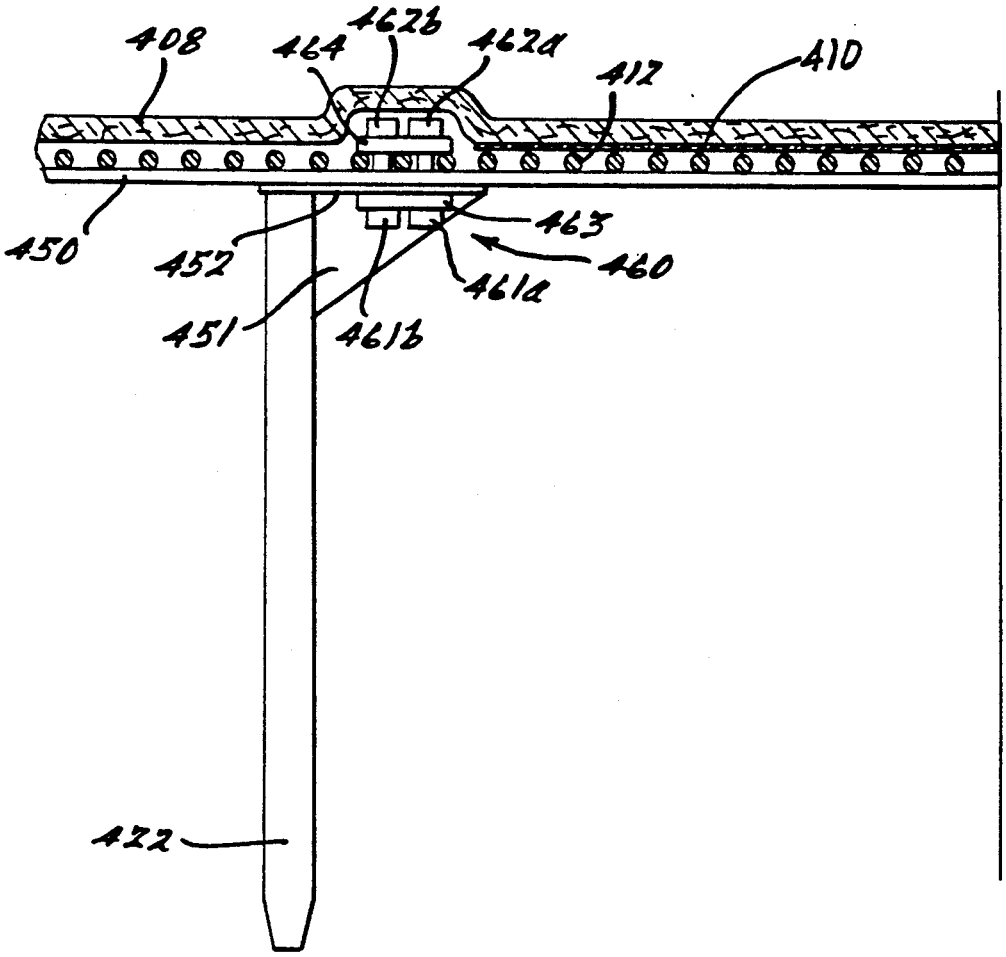
FIG. 4 is a partial sectional view of a paint spray booth showing the details of how a partition wall may be removably coupled to the ceiling of the paint spray booth.

With reference to FIG. 4, apparatus for removably coupling the partition walls to the grated or mesh ceiling of the booth is set forth.

Partition wall 422 is provided with a mounting flange 452 extending in a plane parallel to mesh ceiling 412 and a stiffener plate 451 connecting partition 422 and flange 452.

Partition mounting assembly 460 includes mounting bolts 461*a* and 461*b*, mating nuts 462*a* and 462*b*, lower mounting plate 463, and upper mounting plate 464. As seen from FIG. 4, the mounting flange 452 may be removably coupled to mesh 412 via filter support framework 450, anywhere other than directly beneath air flow control unit 410 (corresponding, e.g. to units 110*a* or 110*b* of FIG. 1), by inserting bolts 461*a* and 461*b* through mating holes in mounting plates 463 and 464 which have been aligned with openings in mesh 412 on opposing sides thereof and retaining bolts 461*a* and 461*b* via respective threaded nuts 462*a* and 462*b*.

Utilization of this invention fulfills the underlying purpose of minimization of air supply volume required for each spray booth paint application zone, which, in turn, lowers investment costs attendant to the air supply unit, exhaust system and solvent abatement systems. Use of lower air flow lowers energy costs which are a major factor in running costs attendant to operating such spray paint booths. Additionally, with the arrangement of the invention, maintenance of a proper air flow in the workstation areas of the booth leads to increased paint transfer efficiency.

The invention has been described with reference to detailed descriptions of preferred embodiments for the sake of example only. The scope and spirit of the invention are to be defined in the appropriately interpreted appended claims.

I CLAIM:

1. In a paint spray booth enclosure having controlled air flow through a perforated ceiling and a perforated floor, the floor and ceiling interconnected by vertically extending booth outer side walls, the improvement comprising:

at least one partition wall positioned interiorly of the booth's outer side walls, the partition wall coupled to and extending downwardly from the perforated ceiling to a preselected non-zero height above the perforated floor; and air flow control means operative to alter the controlled air flow through a space between the partition and side walls.

2. The improvement of claim 1, wherein the at least one partition wall may be positioned at various distances from the outer walls to suit a work space required at each work station in the booth.

3. The improvement of claim 1, wherein the at least one partition wall is substantially planar.

4. The improvement of claim 3, wherein the at least one partition extends from the perforated ceiling at an angle of substantially 90°.

5. The improvement of claim 1, wherein the airflow control means comprises a perforated plate overlying the space between the partition and side walls for partially blocking air flow therethrough.

6. The improvement of claim 5, wherein the perforated plate includes means for adjusting size of perforations therein, thereby enabling adjustment of air flow rate therethrough.

7. In a paint spray booth enclosure having controlled air flow through a perforated ceiling and a perforated floor, the floor and ceiling interconnected by vertically extending first and second booth outer side walls, the improvement comprising:

first and second partition walls positioned interiorly of the booth outer side walls defining a first air flow space between the first and second partition walls, a second air flow space between the first partition wall and the first outer side wall, and a third air flow space between the second partition wall and the second outer side wall, the first partition wall coupled to and extending downwardly from the perforated ceiling to a first preselected height above the perforated floor, and the second partition side wall coupled to and extending downwardly from the perforated ceiling to a second preselected non-zero height above the perforated floor;

first air flow control means operative to alter air flow through the second air flow space; and second air flow control means operative to alter air flow through the third air flow space.

8. The improvement of claim 7, wherein at least one of the first and second partition walls is removably coupled to the perforated ceiling so as to enable varying a dimension of the first air flow space.

9. The improvement of claim 7, wherein air flows through the first air flow space at a rate higher than air flow through the second and third air flow spaces.

10. The improvement of claim 7, wherein one of the first and second air flow control means comprises a first perforated plate overlying one of the second and third air flow spaces for partially blocking air flow therethrough.

11. The improvement of claim 10, wherein the other one of the first and second air flow control means comprises a second perforated plate overlying the other one of the second and third air flow spaces for partially blocking air flow therethrough.

12. The improvement of claim 10, wherein the first perforated plate includes means for adjusting size of perforations therein.

13. The improvement of claim 11, wherein the first and second perforated plates each include means for adjusting size of perforations therein.

14. The improvement of claim 7, wherein at least one of the first and second partition walls is substantially planar.

15. The improvement of claim 7, wherein at least one of the first and second partition walls extends from the ceiling at an angle of on the order of 90° .

* * * * *